United States Patent [19]

Mallard et al.

[11] Patent Number: 5,004,071

[45] Date of Patent: Apr. 2, 1991

[54] ADAPTOR BRACKET

[75] Inventors: Bobby J. Mallard, Virginia Beach; Richard H. Knapp, Norfolk; W. J. Roper, Virginia Beach; Daniel R. Harrison, Norfolk, all of Va.

[73] Assignee: Specialized Shipping Products, Ltd., Norfolk, Va.

[21] Appl. No.: 520,652

[22] Filed: Apr. 13, 1990

[51] Int. Cl.[5] ..... A62B 35/00

[52] U.S. Cl. ..... 182/3; 248/499; 410/82

[58] Field of Search ..... 182/3–7, 182/232–235, 236, 237, 238, 240; 248/499; 410/82, 83, 78

[56] References Cited

U.S. PATENT DOCUMENTS

| | | | |
|---|---|---|---|
| 580,961 | 4/1897 | Steiman | 182/235 |
| 2,990,131 | 6/1961 | Carlsson | 242/107.4 |
| 3,796,404 | 3/1974 | Shields | 248/499 |
| 4,139,228 | 2/1979 | Varadi | 410/82 |
| 4,171,795 | 10/1979 | Bianchi | 254/151 |
| 4,567,961 | 2/1986 | Schoenfeld | 182/3 |
| 4,626,155 | 12/1986 | Hlinsky | 410/82 |
| 4,630,982 | 12/1986 | Fenner | 248/499 |
| 4,645,392 | 2/1987 | Tagaguchi | 248/499 |
| 4,699,245 | 10/1987 | Benedet | 182/3 |
| 4,705,140 | 11/1987 | Dudley et al. | 182/3 |
| 4,721,182 | 1/1988 | Brinkmann et al. | 182/3 |
| 4,852,692 | 8/1989 | Flaherty | 182/5 |

*Primary Examiner*—Reinaldo P. Machado
*Attorney, Agent, or Firm*—John E. Benoit

[57] ABSTRACT

An adaptor bracket for rotatably securing a retractable lifeline block to a corner casting on a cargo retaining frame wherein the bracket has a locked position when it is secured to the corner casting and an unlocked position for removal from the corner casting. The bracket includes a twist lock which is spring-biased such that insertion of the twist lock into an opening in the corner casting automatically turns the twist lock to the locked position. Manual pressure and rotation of the twist lock placed it in the unlocked position for removal from the corner casting. The adaptor bracket and the retractable lifeline block are rotatable relative to the corner casting when in the locked position. Also disclosed is a standard method of using the adaptor bracket at a work site.

17 Claims, 5 Drawing Sheets

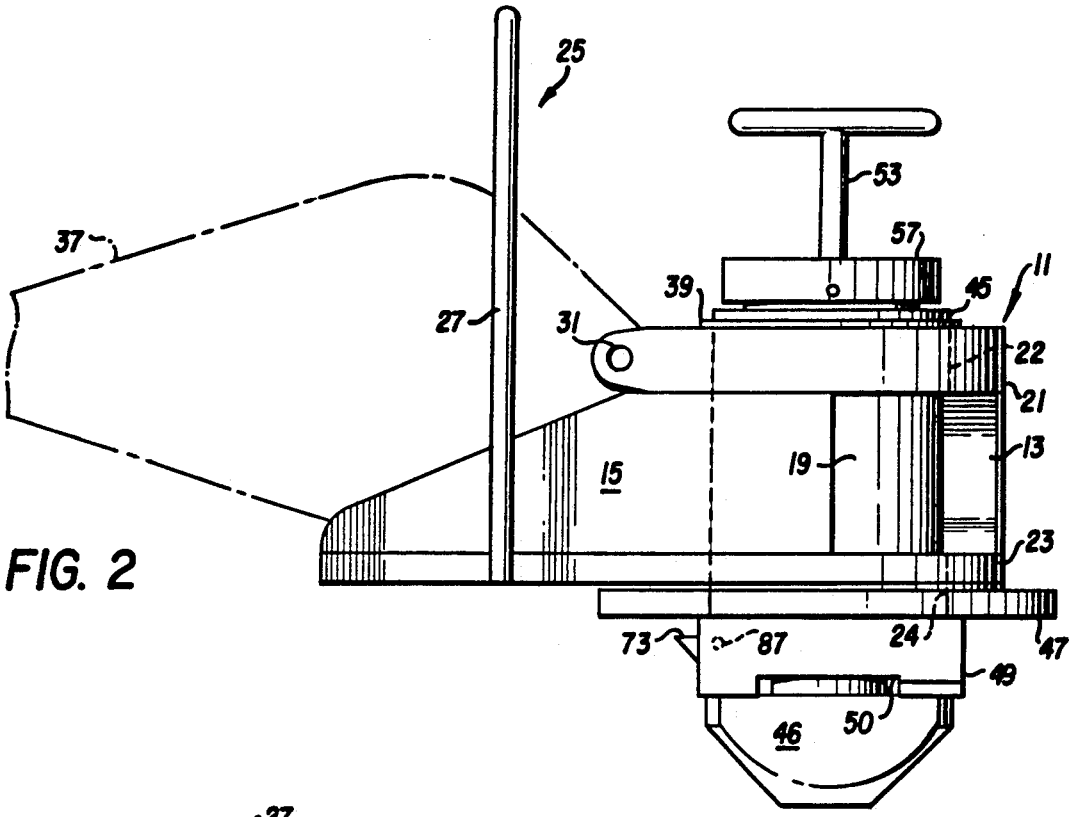
FIG. 2
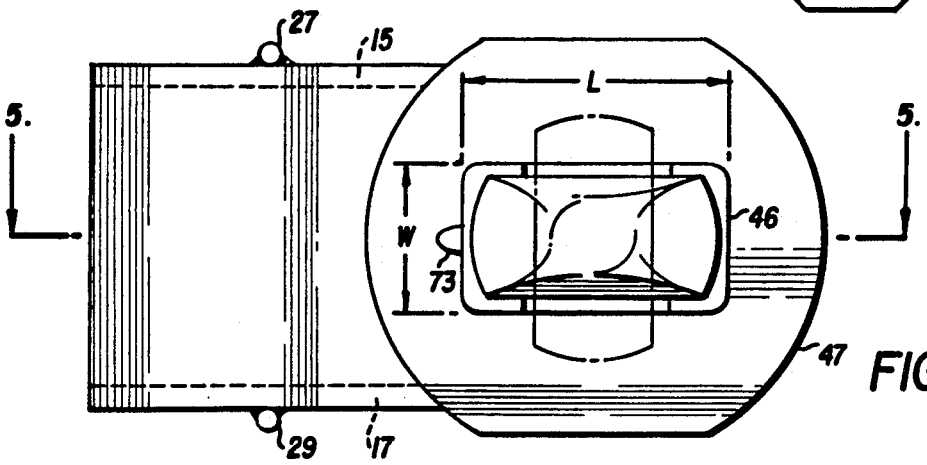
FIG. 3
FIG. 9
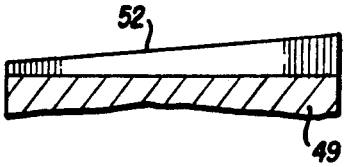

ADAPTOR BRACKET

This invention relates generally to safety in the handling of containerized cargo, and more particularly to an adaptor for rotatably securing a retractable lifeline block to a corner casting mounted either on a container frame or other equipment frame used with the handling of containerized cargo.

BACKGROUND OF THE INVENTION

For a number of years, cargo ships have been carrying their loads in large rectangular boxes called containers. These containers are constructed of a framework of steel or the like and are also strengthened so as to withstand pressures created by stacking one container upon the other and by various forces which are encountered at sea. Although these containers come in various sizes, the more standard size is substantially the same as a large truck van.

Containers are loaded and unloaded and moved about by cranes. A spreader bar suspended by the crane engages eyes which exist in the corner castings on the containers. The crane raises the spreader bar to hoist the container aloft and move it to its desired location.

It is common practice to stack containers vertically and horizontally to form rows. In order to join and lock the upper corners of adjacent containers so as to prevent accidental slippage, devices called stacking pads are used. These stacking pads are placed for locking and unlocking by workmen or "lashers" who move across the top of the stacks.

While the safety of the workmen has always been a great concern, recent government restrictions and rules require that some type of safety device be provided for protection of the lashers. Various devices have been proposed, including the use of a safety cage which is hoisted atop a stack of interlockable cargo containers and which allows the lashers to operate within the cage and still have access to the locks. Such a cage is shown and described in U.S. Pat. No. 4,705,140, issued Nov. 10, 1987. The cage includes a reel tether hanging from a trolley which rolls along the athwartship extensions of a roof boom and hooks onto a worker's safety harness to enable him to leave the cage.

While this cage provides safety, it is also cumbersome and obviously requires considerable expense to equip a terminal with the necessary number of cages.

The present invention provides a means for rotatably connecting a retractable lifeline block to a corner casting of the frame for the container or to a similar casting which might be mounted on a crane working to load and unload the containers. Such a device allows each worker to have a self-contained unit for attaching between his harness and to the casting so as to provide individual protection while still providing an economical apparatus for providing such a function.

SUMMARY OF THE INVENTION

The present invention provides an adaptor bracket for rotatably securing a retractable lifeline block to a corner casting on a cargo-retaining frame or similar casting mounted on any frame wherein the bracket has a locked position when it is secured to the corner casting and an unlocked position for removal from the corner casting. The bracket includes a twist lock which is spring-biased such that insertion of the twist lock into an opening in the corner casting automatically sets the twist lock to the locked position. Manual pressure and rotation of the twist lock places it in an unlocked position, where it is secured by a releasable pin. This permits simple automatic locking upon insertion in the corner castings and unlocking and removal by manual pressure. The bracket and the attached retractable lifeline block are rotatable relative to the casting when in the locked position.

Thus, the worker may easily carry the adaptor because of its relative light weight and is fully in control of its use in its locked and unlocked position. The automatic locking feature ensures that the device cannot be used unless it is locked in place.

These and other objects of the invention will become apparent from the following description, taken together with the drawings.

BRIEF DESCRIPTION OF THE DRAWINGS

FIG. 2 is a side view of the adaptor bracket of the present invention;

FIG. 3 is a bottom view of the adaptor bracket of FIG. 2 showing lock and unlock positions;

FIG. 9 is a view taken along the lines 9—9 of FIG; 8;

DETAILED DESCRIPTION OF THE PREFERRED EMBODIMENT

Figure 1:
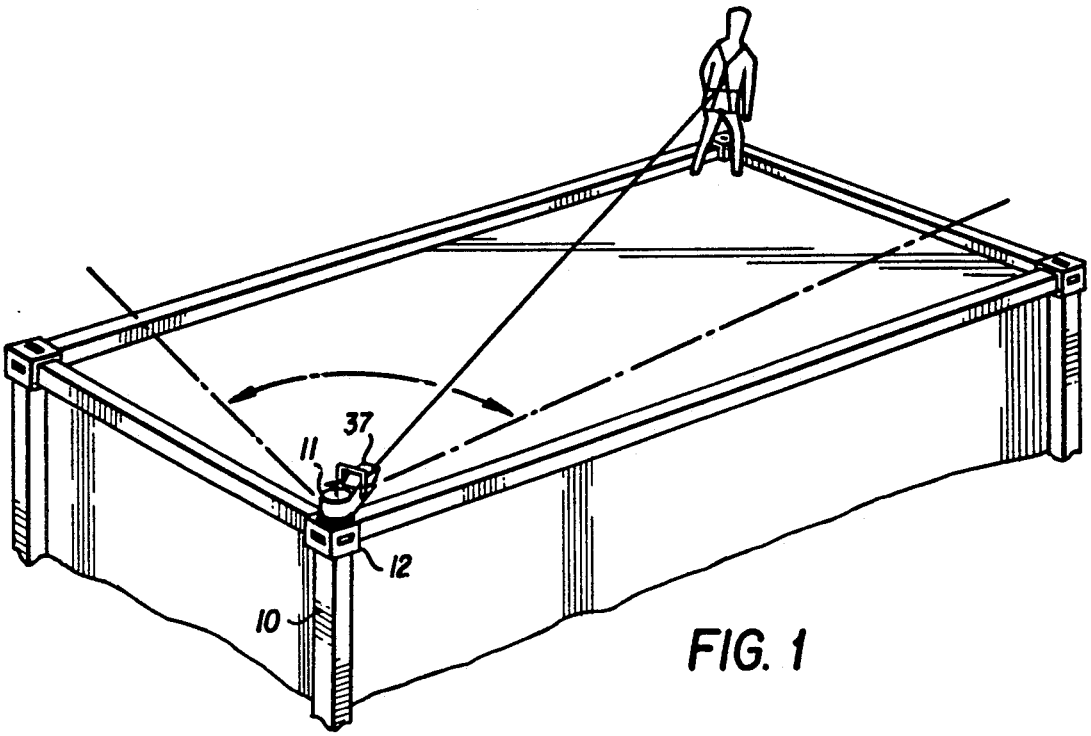
FIG. 1 is a perspective view showing the adaptor bracket of the present invention in actual usage on top of a cargo container.

FIG. 1 schematically shows a container frame 10 which terminates at each corner with corner casting 12. This corner casting is more clearly shown in detail in FIG. 9. Adaptor bracket 11 of the present invention is shown as locked to corner casting 12. Retractable lifeline block 37 is secured at one end to adaptor 11 and has extending therefrom a lifeline safety block which is secured to the harness of the worker. Such lifeline safety blocks are well known, one being manufactured and sold by D. B. Industries, Inc. of Red Wing, Minn. When in use, any sudden pressure caused by a slip or a fall results in a suddent jerk in the cable, which activates a braking mechanism within the safety block and the worker is brought to a stop in a very short distance.

Figure 4:
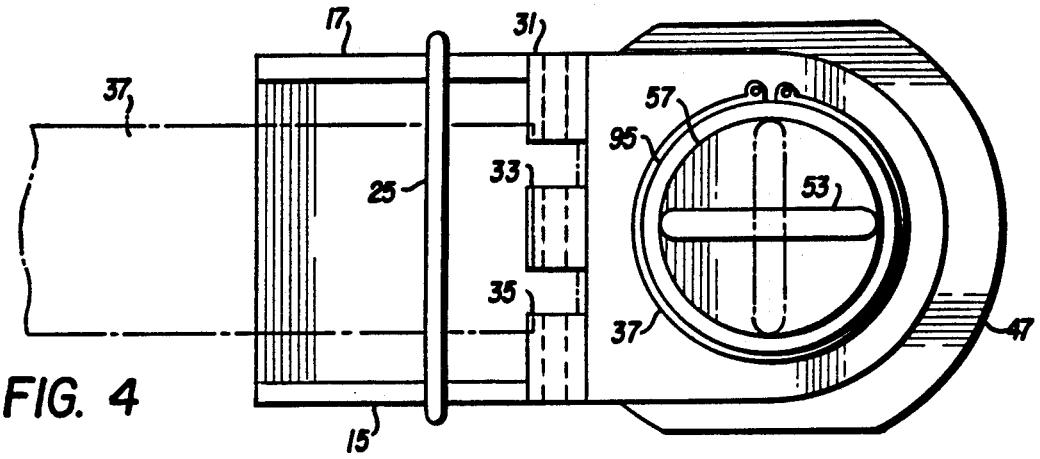
FIG. 4 is a top view of the adaptor bracket of FIG. 2.

Turning to FIGS. 2, 3, and 4, there is shown the exterior configuration of the adaptor bracket of the present invention. Adaptor bracket 11 includes housing 13, with side plates 15 and 17 extending outwardly from the housing. Although not required, housing 13 includes openings 19, which do not reduce the strength of the housing but do reduce the weight. Upper plate 21 extends across the major portion of the housing while lower plate 23 extends across the major portion and supports side plates 15 and 17. U-shaped handle 25 is secured at legs 27 and 29 to lower plate 23 and side plates 15 and 17. This provides a convenient means for carrying the adaptor plate. As can be seen more clearly in FIG. 4, borehole 31 extends transversely across the edge of the upper plate which includes slots 33 and 35. This particular design allows retractable lifeline block 37 to be placed within the slots and secured therein by means of a bolt or the like. Normal usage would include the adaptor bracket and lifeline block be retained as a single unit.

Figure 5:
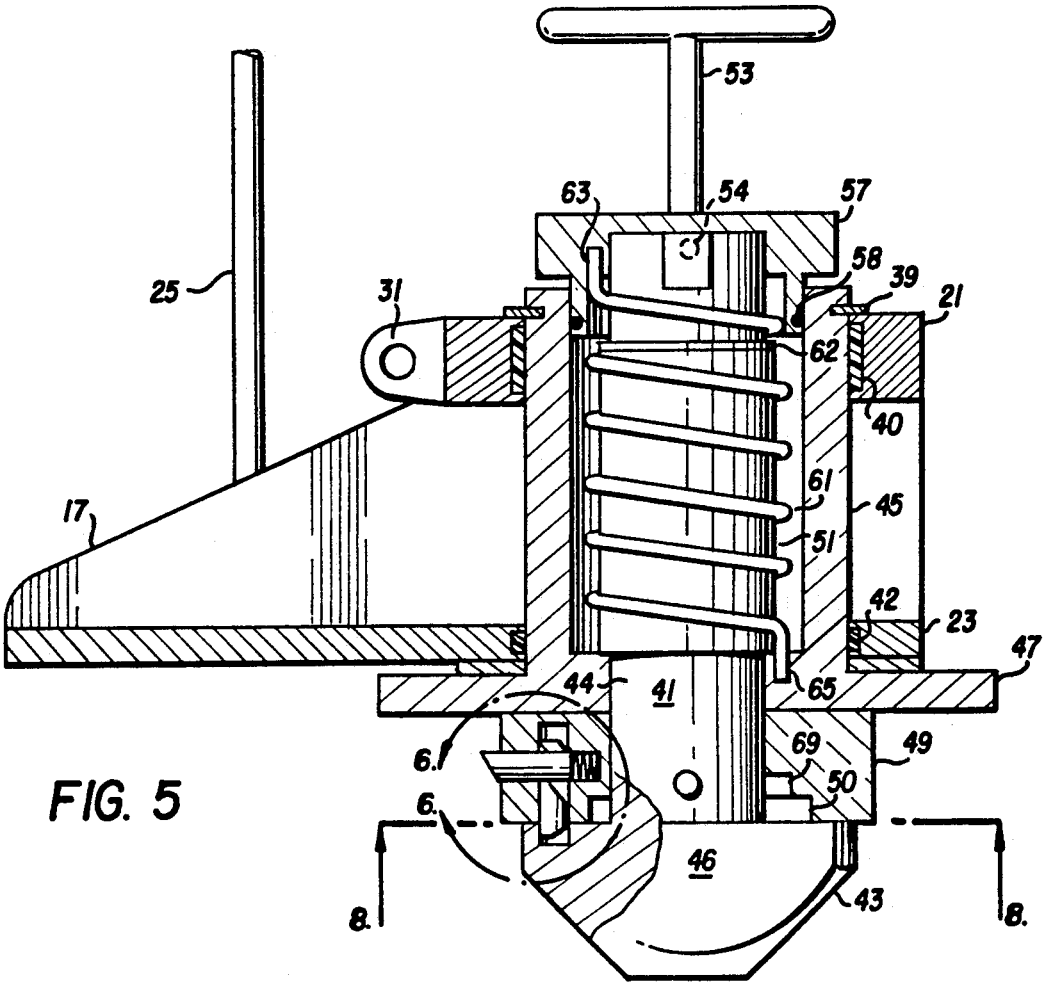
FIG. 5 is a sectional view taken along the lines 5—5 of FIG. 3 in unlock position.

Upper plate 21 and lower plate 23 both include circular openings 22 and 24 through which cylinder 45 (FIG. 5) passes. As shown in FIG. 5, the lower part of the cylinder includes flange 47. Cylinder 45 is held in place by lock ring 39. Upper and lower plates 21 and 23 include interior circular teflon bearings 40 and 42. This prevents direct contact between the upper and lower plates and cylinder 45 as the housing rotates about cylinder 45 during use.

Twist lock 41 includes shaft 44, which terminates at its lower end in a substantially rectangular-shaped head 46 which includes cammed faces 43. Operating handle 53 and cap 57 are secured to the opposite end of twist lock 41 by means of a bolt 54 or the like. Sleeve 51 fits over shaft 44 within spring 61. Shaft 44 has a groove (not shown) about which lock ring 62 fits so as to retain sleeve 51 in the position shown. Sleeve 51 provides added retention strength so as to reduce the stress on bolt 54 and also prevents release of twist lock 41 in the event of separation of handle 53 and cap 57. Cap 57 includes O-ring 58 and is slidable within cylinder 45. Handle 53, cap 57, and twist lock 41 all move as a unit.

Spring 63 is connected to cap 57 at one end 63 and to cylinder 45 at the other end 65. Twist lock 45 includes pin 57 extending outwardly therefrom for reasons which will be described as the description proceeds.

Rectangular guide block 49, which is integral with cylinder 45 and flange 47, depends below flange 47. Guide block 49 includes 90° recess 69 and channel recess 50. Recess 69 is designed to mate with pin 67, as will be discussed. The width of channel recess 50 is greater than the narrower dimension W of rectangular head 46 (FIG. 3).

The adaptor bracket as shown in FIG. 5 appears in its unlocked position, which is the position required when it is not secured within the corner casting. In this position, head 46 is shown with its length L extending beyond channel recess 50 and bearing against the bottom of guide block 49. In this position, handle 53 has been depressed and turned so as to rotate twist lock 41, thus creating a biasing torque and tension on the spring which would tend to pull on and rotate head 46 relative to guide block 49. This is the unlocked position as shown in solid lines of handle 53 in FIG. 4.

In order to prevent rotation of head 46 relative to guide block 49, pin lock mechanism 71 is used. This pin lock mechanism is shown in greater detail in the enlarged view of FIG. 6. The mechanism consists of two mating pins which ride in mating boreholes in guide block 49. Pin 73 is biased outwardly by compression spring 75 while pin 77 moves substantially vertically under the influence of the movement of pin 73. The two pins have mating male and female sections which include raised rib 79 on male pin 73 and recess 81 on female pin 77. Male pin 73 includes machine-flattened area 83 while female pin 77 includes machine-flattened area 85. These flattened areas allow the pins to slide relative to each other under the forces of the male/-female rib and slot relationship. Pin 87, shown in dotted lines in FIGS. 2 and 6, extends through guide block 49 into flattened area 83 of pin 73 and bears against raised rib 79 in the locked position as shown. This prevents movement outwardly of pin 73 beyond the position shown under the influence of spring 75.

Figure 7:
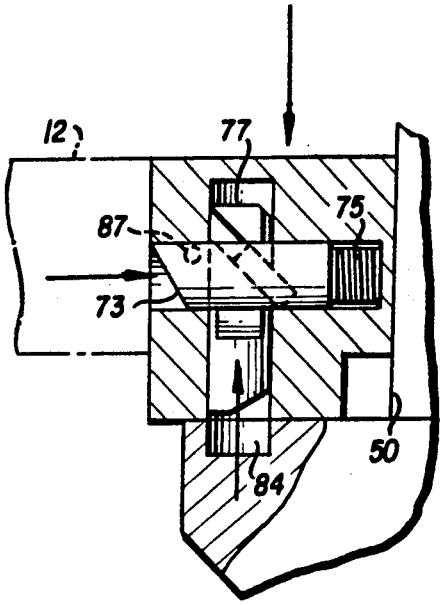
FIG. 7 is a view similar to FIG. 6, with the locking mechanism in the locked position.

When the adaptor bracket is placed into opening 14 of corner casting 12 (FIG. 10), rectangular guide block 49 and head 46 pass into the opening. The edges of opening 14 engage the cammed surface of pin 73 in guide block 49 and force it inwardly against the bias of spring 75. The walls of the opening in the corner casting hold block 49 immobile. Because of the relationship of the two pins, raised rib 79 will slide along slot 81, causing pin 77 to move upwardly within borehole 82 and free of borehole 89. This allows head 46 to rotate to the locked position. The locked position of pins 75 and 77 is shown in FIG. 7.

Figure 6:
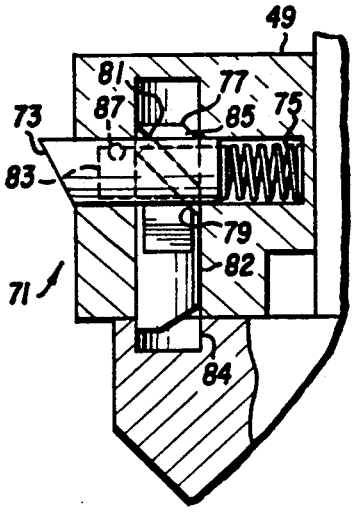
FIG. 6 is an enlarged view of the area 6—6 of FIG. 5.

When in the position shown in FIG. 6, one end of pin 77 extends into borehole 84 in head 46. When in this position, it prevents head 46 and shaft 44 from rotating relative to cylinder 45 and integral block 49 under the influence of the bias of spring 51. In viewing the head from the bottom (FIG. 3), the spring provides a torque which tends to bias head 46 into a locked position. This locked position is shown in dotted lines in FIG. 3.

With guide block 49 in an immobile condition, once pin 77 has been cleared from borehole 84, spring 55 rotates twist lock 41, including head 46, to the dotted line position shown in FIG. 3. This, in turn, aligns the shorter dimension W of head 46 with channel recess 50 and the tension on the spring pulls head 46 upwardly into the chanell recess, thus holding it in that position.

Figure 10:
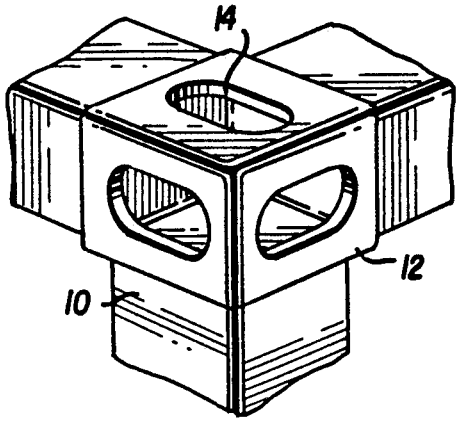
FIG. 10 is a perspective view of a corner casting as shown generally in FIG. 1.
Figure 11:
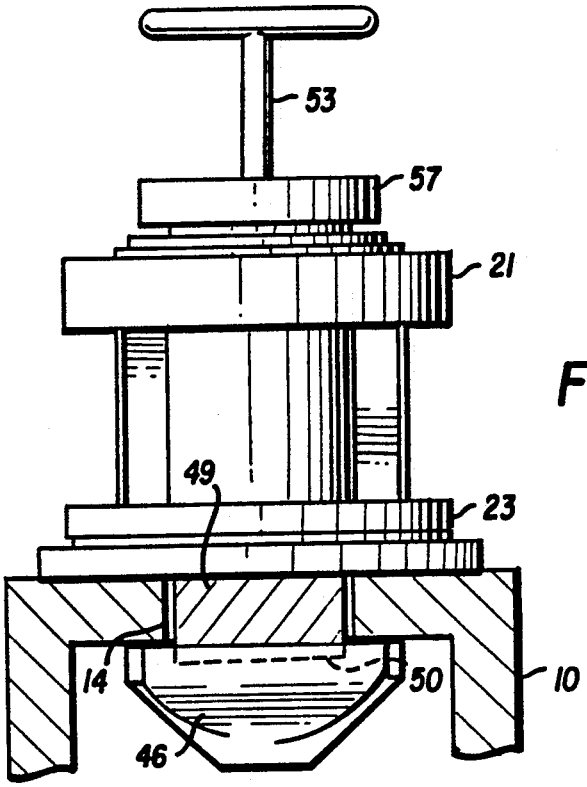
FIG. 11 is a partial sectional view of the adaptor bracket in place within a corner casting.

Referring to FIGS. 10 and 11, adaptor bracket 11 has been placed in opening 14, with the longer length of guide block 49 and the longer length L of head 46 mating with the longer length of opening 14. As head 46 passes through opening 14 and the guide block passes into the opening, the edge of the opening strikes the cammed edge of pin 71 on guide block 49, thus forcing it inwardly to the position shown in FIG. 7, which raises pin 77 out of borehole 84 and automatically releases twist lock 41. Head 46 is rotated to a position wherein its longer length L is transverse to the longer length of the opening 14 and it is pulled into channel recess 50, securing it in place across opening 14. This is the locked position shown in dotted lines in FIG. 3. During movement of head 46 to locked position, block 49 and associated cylinder 45 are held substantially immobile while head 46 rotates.

When it is desired that the adaptor bracket be removed from the corner casting, handle 53 is depressed and rotated 90° so as to remove it from the corner casting. This realigns borehole 84 with pin 77. As the adpator bracket is being removed from the corner casting, pin 73 clears the inner wall opening 14 before the lower section of guide block 49 and head 46, and the pin is biased outwardly so as to move pin 77 into borehole 84, thus securing head 46 in its unlocked position.

Figure 8:
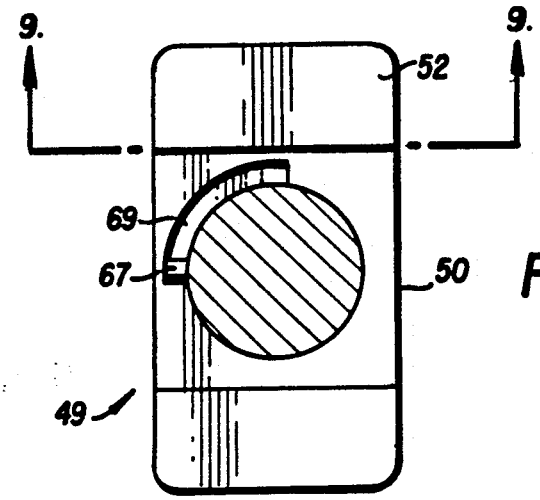
FIG. 8 is a view taken along the lines 8—8 of FIG. 5.

FIG. 8 is a view taken along the lines 8—8 of FIG. 5 and illustrates the function of pin 67 and recess 69. Pin 67 rests in recess 69, which includes an arc of substantially 90° within rectangular guide block 49. This permits the necessary rotation of twist lock 41 between a locked and unlocked position, but prevents movement beyond these limits.

FIG. 10 is a sectional view taken along lines 9—9 of FIG. 8. Surface 52 on guide block 49 is machined to form a slightly cammed surface. The surface on the other side is machined to form a camming surface in the opposite direction. These two surfaces assist in the manual rotation of the twist lock.

It should be noted that accidental striking of pin 71 when the adaptor bracket is not in the corner casting will cause misalignment of head 46 and guide block 49 so that the adaptor cannot be mated with the corner casting. This ensures that the head and guide block must be manually realigned to the unlocked position before the adaptor can be used.

Preferably, the devices according to the invention are used in pairs that are carried to the tops of container stacks by the spreader bar of a conventional quayside gantry crane. As is known in the art, such spreader bars have downwardly facing twist lock mechanisms at their four corners in order to engage the upwardly facing twist lock apertures of individual cargo containers. A spreader bar will normally have a passenger cage which carries workmen to the container tops.

Figure 12:
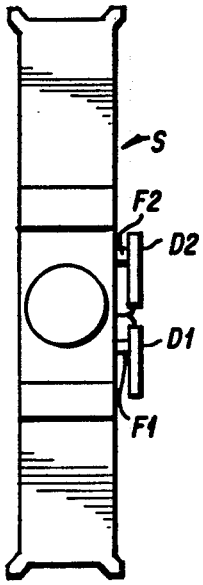
FIG. 12 is a schematic illustration of the use of the adaptor bracket on a spreader bar.

According to one feature of the invention, the spreader bar acts as a carrier to which two of the lifeline safety devices are locked when the spreader bar is moving to a container top worksite. As shown diagramatically in FIG. 12, the spreader bar is provided with two fittings F1 and F2 that each have twist lock receiving apertures capable of being releasably engaged by the lock means of the safety devices D1 and D2. These fittings may be identical to the corner castings of the containers.

As previously described, each of the safety devices D1 and D2 has an adaptor bracket provided with a releasable lock means for engaging the twist lock receiving apertures on the corner fittings of the containers, and a retractable lifeline block mounted on the adaptor bracket. Each lifeline block has an extensible cable, means for braking the cable when it is pulled suddenly, and a hook, harness, or other cable connector means for connecting the extensible end of the cable to a worker. With the arrangement shown in FIG. 12, the spreader bar provides a relatively stable platform to which a retractable lifeline block may be anchored while a worker sets another such lifeline block at one of the container corners and locks it thereto.

Figure 13:
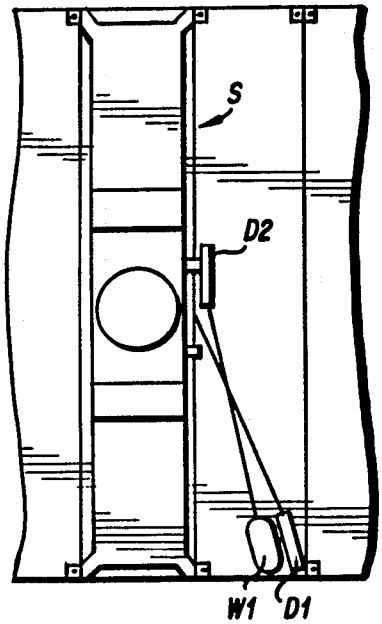
FIG. 13 is a schematic illustration of one method of using adaptor brackets by a workman.
Figure 14:
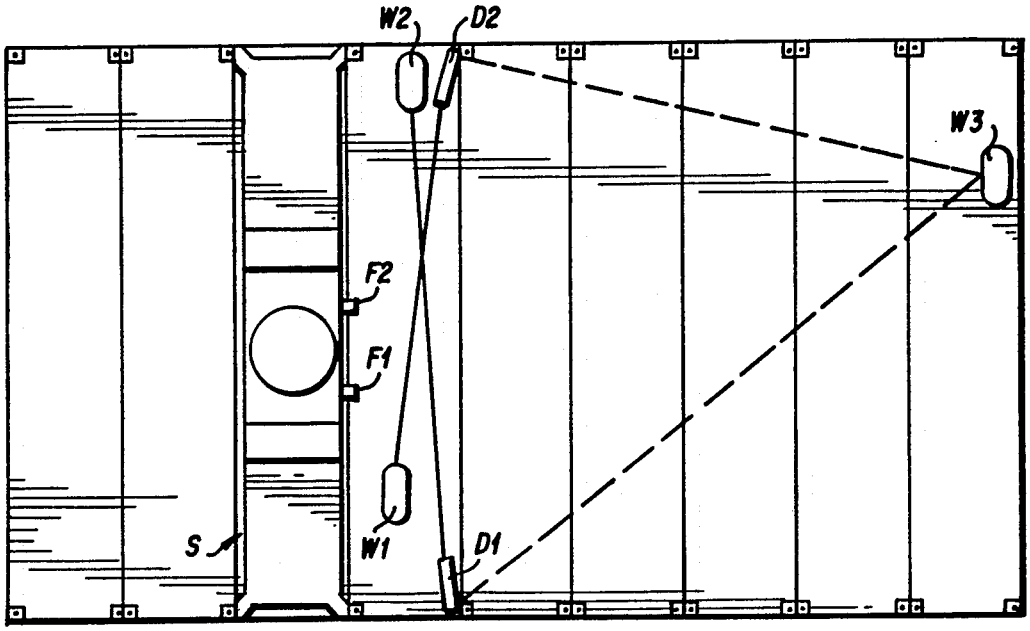
FIG. 14 is a schematic illustration of the use of the adaptor brackets at a work site.

A preferred procedure for setting the blocks is illustrated diagramatically in FIGS. 13 and 14. For illustrative purposes, the sizes of the fittings, safety devices, and workers have been exaggerated in these drawings.

When the spreader bar is moved to the work site, two workers can be carried in the personnel cage and safety devices D1 and D2 are locked to fittings F1 and F2 by the previously described twist lock mechanism of the adaptor brackets. The connectors at the ends of the cables are attached to a ring or other connector-receiving means on the spreader bar so that the devices can be concurrently retrieved in case the safety devices are accidentally unlocked from the spreader bar.

In the procedure shown in FIG. 13, worker W1, who is initially on spreader bar S, connects the cable connector of device D2 to himself, disconnects device D1 from fitting F1, and then walks to a corner casting at the aft edge of the container array and locks device D1 to the corner casting. The connector at the extensible end of device D1 preferably remains attached to the spreader bar during this time so that it is available to worker W2, who then connects himself to the connector at the end of the cable of device D1. At this point, worker W1 steps back a safe distance from the edge of the containers. Worker W2 is protected from falling because he is connected to the cable of device D1 that is anchored to the container. Worker W2 disconnects device D2 from spreader bar S and carries device D2 to the corner fitting at the forward end of the container array, where he locks it to the aperture at this fitting. Workers W1 and W2 are now safely tied to corner castings on opposite edges of the container array and may proceed to perform their tasks, always being certain their respective safety devices are at opposite edges of the work site from where they are working, as can be seen in FIG. 1.

FIG. 14 shows that the work site has a long athwartalyn edge and short fore-and-aft edges, and that devices D1 and D2 are attached to corner fittings which are near the middle of the long edges.

After the workers are safely tied to their safety devices, as shown in FIG. 14, and are a safe distance from the spreader bar, the crane may be operated conventionally, using the spreader bar to engage and move containers.

When the workers get toward the end of the container array, it is desirable for a single worker to connect himself to the connector means of both devices D1 and D2, as can be seen in the case of worker W3 in FIG. 11, where the locations of the cables are illustrated by broken lines.

As will now be evident, the present invention provides a reliable and economical portable safety device for use by workmen servicing cargo containers.

The above description and drawings are illustrative, only, since equivalent components could be substituted without departing from the invention, the scope of which is to be limited only by the following claims.

We claim:

1. An adaptor bracket for rotatably securing a retractable lifeline block to a corner casting mounted on a frame, said adaptor bracket comprising cylindrical means;

a shaft rotatably mounted and axially movable within said cylinder means, said shaft terminating in a substantially rectangular head extending outwardly from said cylindrical means;

a cap and handle secured to the end of said shaft opposite said head;

spring means secured between said cap and said cylindrical means, whereby rotation and depression of said cap, handle, shaft, and head relative to said cylinder while said cylinder is immobile creates a tension and torque bias in said spring;

means for releasably securing said head in said spring-biased position; and means for rotatably mounting a housing about said cylindrical means.

2. The adaptor bracket of claim 1 further comprising means on said housing adapted to secure a retractable lifeline block thereto.

3. The adaptor bracket of claim 1 further comprising a sleeve movably secured about said shaft within said cylinder.

4. The adaptor bracket of claim 1 wherein said means for releasably securing said head in said spring-biased position comprises a movable pin in said cylindrical means for engaging and disengaging a borehole in said head.

5. The adaptor bracket of claim 1 further comprising means for limiting the rotation of said cap, handle, shaft, and head to substantially ninety degrees.

6. An adaptor bracket for rotatably securing a retractable lifeline block to a corner casting mounted on a frame, said adaptor bracket comprising a housing;

means on said housing adapted to secure a retractable lifeline block thereto;

a twist lock having a shaft with a substantially rectangular head at one end of said shaft;

means for rotatably securing said shaft within said housing with said rectangular head extending outwardly from said housing;

spring means secured between said means for rotatably securing said shaft within said housing and said twist lock;

means for axially moving and rotating said twist lock relative to said means for rotatably securing said shaft within said housing so as to create a torque and tension bias in said spring; and releasable means for securing said twist lock in said spring-biased position when said twist lock has been rotated through a predetermined arc;

whereby, when said releasable means is activated, said twist lock, including said head, returns to its unbiased position.

7. The adaptor bracket of claim 6 wherein said means for rotatably securing said shaft within said housing comprises a cylinder mounted within and extending outwardly from said housing.

8. The adaptor bracket of claim 6 further comprising means for rotatably mounting said housing about said cylinder.

9. The adaptor bracket of claim 6 further comprising means for limiting the rotation of said twist lock relative to said means for securing said shaft within said housing to substantially ninety degrees.

10. The adaptor bracket of claim 6 further comprising means for rotatably connecting said housing about said means for securing said shaft within said housing.

11. An adaptor bracket for rotatably securing a lifeline block to a corner casting mounted on a frame, said adaptor bracket comprising a twist lock including a shaft and a substantially rectangular head, said head adapted to mate with an opening in a corner casting;

means for removably securing said head within said corner casting;

a housing rotatably mounted about said twist lock; and means on said housing adapted to secure a retractable lifeline block thereto.

12. Fall protection apparatus for workers who service ship cargo containers of the type that have fittings with twist lock receiving apertures, comprising two safety devices that each include (a) an adaptor bracket provided with releasable lock means for engaging a said twist lock receiving aperture and (b) a retractable lifeline block mounted on said adaptor bracket;

each of said retractable lifeline blocks including an extensible cable, means for braking the cable when it is pulled suddenly, and a cable connector means for connecting the cable to a worker;

a carrier means for moving both of said safety devices to work sites on top of said cargo containers, said carrier means having two twist lock receiving apertures that are engagable by the releasable lock means of the safety devices to releasably lock both of said safety devices to said carrier, said lock means on said adaptor bracket being locked to said carrier to provide fall protection to a worker attached to the connection means thereof, said lock means being unlockable from the carrier to permit movement of said devices to twist lock receiving apertures on a container so that a worker can be connected by the safety device to the container itself.

13. Appartus according to claim 12 in which the carrier means has means for receiving said cable connector means of the lifeline blocks before the cable connector means are attached to workers, whereby the devices can be retrieved at the carrier means if their lock means become accidentally detached from the carrier.

14. Apparatus according to claim 12 in which the carrier is the spreader bar of a crane.

15. A method of providing fall protection to workers who service ship cargo containers provided with twist lock receiving apertures, said method including the following steps:

providing a movable carrier for moving safety devices to a work site on top of a ship cargo container, said carrier including a twist lock receiving aperture corresponding to said apertures on ship cargo containers;

providing a first retractable lifeline device and a second retractable lifeline device that each have a releasable aperture engaging lock, an extensible cable, a cable connector means for connecting the cable to a worker, and means for braking the cable when it is pulled suddenly;

simultaneously moving the carrier to a work site on top of a ship cargo container with at least one of the safety devices being locked to the carrier;

using a first worker to carry said first safety device from the carrier and lock it to a first twist lock receiving aperture of a cargo container, said second safety device having its adaptor bracket locked to the carrier and its cable connector connected to the first worker while the first safety device is being carried to and locked in the twist lock receiving aperture of the container;

unlocking the second safety device from the carrier; and using a worker who is connected to the cable connector of the first safety device to move the second safety device from the carrier to a second twist lock receiving aperture on a container at the work site, and locking said second safety device to said second aperture.

16. A method according to claim 15 in which the work site is a plurality of containers that together form a rectangular array that has two short edges and two long edges and said workers lock the devices to eyes that are near the middle of the long edges located of the work site.

17. A method according to claim 15 in which the carrier is the spreader bar of the crane, and the crane is used to move containers after both of said devices have been attached to the respective first and second eyes.

* * * * *

UNITED STATES PATENT AND TRADEMARK OFFICE

CERTIFICATE OF CORRECTION

PATENT NO. : 5,004,071

DATED : April 2, 1991

INVENTOR(S) : Mallard et al

It is certified that error appears in the above-identified patent and that said Letters Patent is hereby corrected as shown below:

On the title page, item [75], as shown below, correct the names of the first two Inventors.

--Bobby H. Mallard-- and

--Richard N. Knapp--.

Signed and Sealed this

Twenty-fifth Day of August, 1992

*Attest:*

DOUGLAS B. COMER

*Attesting Officer*

*Acting Commissioner of Patents and Trademarks*